United States Patent [19]

Gaffney

[11] 3,960,374

[45] June 1, 1976

[54] SHEET DELIVERY SYSTEM

[75] Inventor: John Marshall Gaffney, Cleveland, Ohio

[73] Assignee: Harris-Intertype Corporation, Cleveland, Ohio

[22] Filed: June 15, 1972

[21] Appl. No.: 262,982

[52] U.S. Cl. ..... 271/189; 271/204; 271/218

[51] Int. Cl.[2] ..... B65H 29/04; B65H 29/34; B65H 31/03

[58] Field of Search ..... 271/88, 77, 78, 68, 271/73, 79, 67, 189, 192, 204–206, 217, 218; 214/6 DK

[56] References Cited

UNITED STATES PATENTS

| | | | |
|---|---|---|---|
| 2,633,357 | 3/1953 | Rooney | 271/88 |
| 3,285,607 | 11/1966 | Lindemann | 271/88 X |
| 3,410,424 | 11/1968 | Rooney | 214/6 DK |
| 3,477,712 | 11/1969 | Stotzer et al. | 271/88 |

FOREIGN PATENTS OR APPLICATIONS

| | | | |
|---|---|---|---|
| 1,145,637 | 3/1963 | Germany | 271/73 |

*Primary Examiner*—Evon C. Blunk
*Assistant Examiner*—Bruce H. Stoner, Jr.

[57] ABSTRACT

Sheet delivery device employing a vertically-movable main pile hoist, a horizontally-insertable auxiliary platen and a racking device having board-supporting ledges immediately below the platen. The auxiliary platen and racking device are mounted on framework of a vertically movable auxiliary pile hoist, and thus move in unison between an upper sheet-receiving limit and a lower pile-discharge limit. When used for pile racking, the platen is first inserted below a conventional sheet conveyor to temporarily receive sheets. A racking board is next inserted below the platen, being supported by side ledges of the racking device. Once the board is in position and the ledges have been removed, the platen may be removed to deposit a newly-forming pile of sheets from the platen onto the board for conventional racking of small sheet piles.

6 Claims, 7 Drawing Figures

SHEET DELIVERY SYSTEM

BACKGROUND OF THE INVENTION

Continuous single-pile sheet deliveries have been known for some time. They consist generally of a main pile support, and an auxiliary support which is moved into position above a full pile on the main support to temporarily receive sheets from a sheet conveyor while the full pile is being removed from the delivery. Such a system is shown in Neri U.S. Pat. No. 2,699,943. An empty new skid is placed on the main support and is brought closely adjacent the bottom of the auxiliary support. The latter is then withdrawn to deposit sheets on the empty new skid thus enabling delivery of sheets to continue uninterrupted.

"Racking" systems, an example of which is illustrated in Rooney U.S. Pat. No. 2,663,357, have also been known for some time. A principal function of such a racking system is to enable the delivery of sheets in small piles, between which are inserted plywood boards. These boards are normally provided with corner-supporting blocks which raise each board slightly above the small sheet pile therebeneath. This not only assists in ink drying, but further reduces offsetting of fresh ink from one sheet against the next by reducing the height and thus the weight of each pile.

Double-delivery systems such as that shown in Niles et al U.S. Pat. No. 2,673,735 enable delivery of sheets to one or the other of a pair of piles. In addition, sheets may be alternately delivered to both. Double-deliveries permit ununinterrupted delivery of sheets, since a full pile can be removed from one pile location while sheets are temporarily delivered to the other. It is not uncommon to find that one of the two deliveries is provided with a racking device to enable accomplishment of the previously-described racking. An example of this general type of system is illustrated in Koch U.S. Pat. No. 3,477,710. While the Koch system does not have a true double delivery, it functions as one by diverting sheets to an alternate pile location during racking.

SUMMARY OF THE INVENTION

This invention relates to a single pile delivery system which is capable of: (1) conventional delivery of sheets to a main hoist and interrupting the machine operation when a pile has been fully built-up on the main hoist, (2) conventional continuous delivery of sheets by using an auxiliary platen in conjunction with the main hoist, to temporarily support a stack of sheets without machine interruption while the full sheet pile on the main hoist is being removed, (3) conventional racking small piles of sheets in conjunction with the auxiliary platen, and interrupting machine operation upon completion of a fully-loaded main hoist, and (4) enabling use of the auxiliary platen to temporarily intercept and support sheets, after which a board is inserted onto a racking device which is carried by the auxiliary hoist and located directly below the platen, and, when a pile is ready for transfer from the auxiliary to the main hoist, the board is first transferred to the main hoist and the platen is then withdrawn to deposit the pile on the board.

DESCRIPTION OF THE PREFERRED EMBODIMENT

Figure 1:
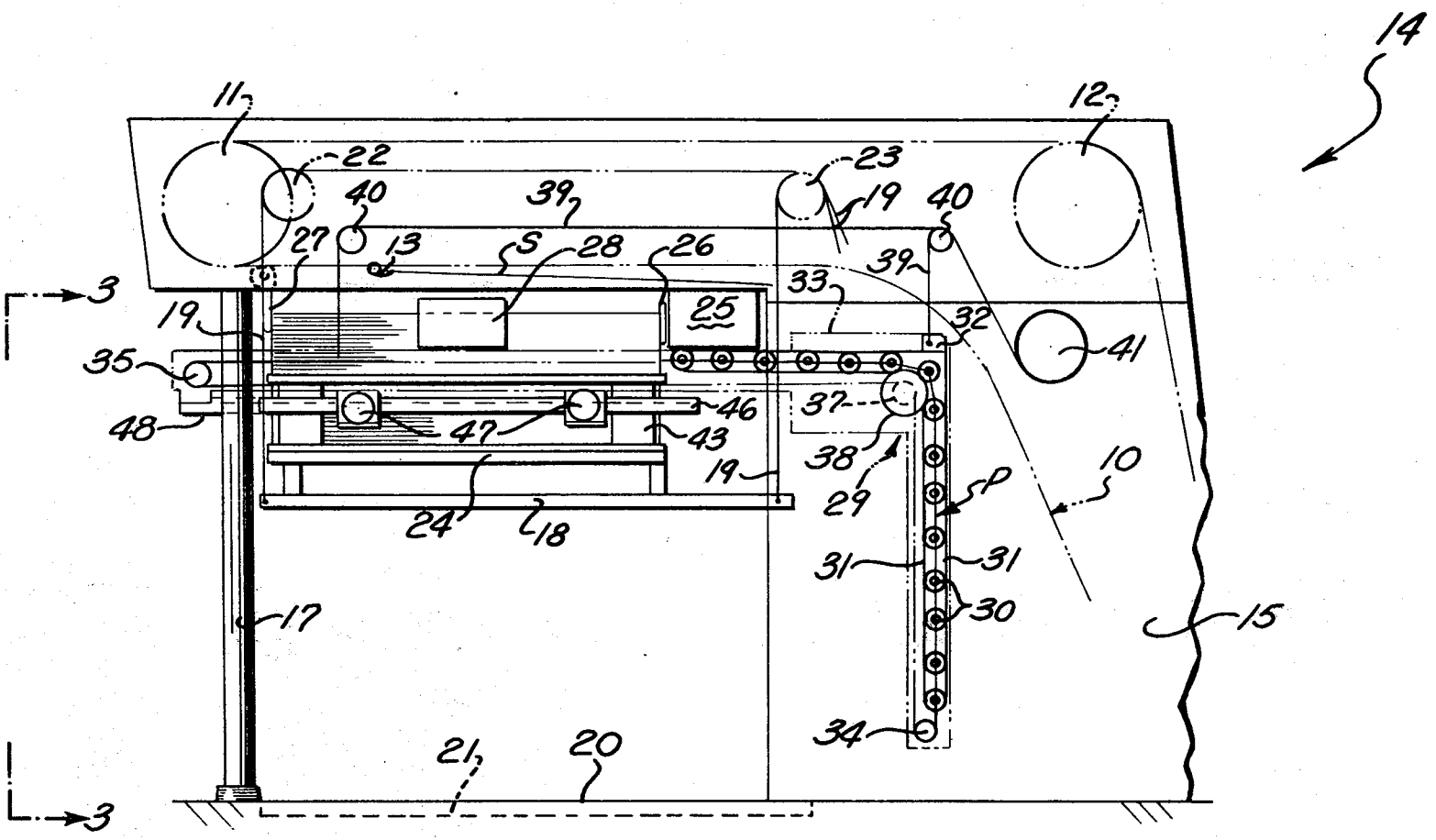
FIG. 1 is a side elevational view of a sheet delivery employing a main hoist, auxiliary platen and racking device of the invention, illustrating the platen in inoperative position during a racking operation.

FIG. 1 illustrates a side elevational view of a sheet delivery. Normally, to the right of FIG. 1 would be a printing press or other sheet handling machine. Sheets are delivered from the sheet handling machine to a continuous chain conveyor 10 of the conventional type used on printing press deliveries. The conveyor 10 passes around curved tracks (not shown) and around sprockets 11 and 12. At the portion of the right of FIG. 1, the conveyor also passes around sprockets on the ends of a conventional delivery cylinder. The conveyor 10 normally comprises a pair of laterally-spaced endless chains, between which are supported gripper bars which mount gripper fingers 13, only one of which is shown in FIG. 1. It is to be understood that the conveyor itself forms no particular part of the invention herein, the chain and gripper system illustrated being merely for explanatory purposes. The conveyor 10 is supported by a pair of spaced frames 14, each of which includes an upstanding portion 15 and a horizontal portion 16. The left ends of the horizontal frame portions 16 are supported by posts 17.

A conventional main hoist consisting of a platform 18 and cables or chains 19 is movable between an upper limit close to but below the horizontal run of the conveyor 10, and a lower position in which the platform 18 is recessed in the floor 20. The recess is shown by the numeral 21, it being understood that the platform 18, when in the recess 21, is flush with the level of the floor 20. This enables a trucking system to be employed to get beneath a loaded skid 24 supported on the platform 18 for removal of the pile from the delivery. The cables 19 pass around pulleys 22 and 23 and are connected to any known type of windup mechanism which is motorized to rapidly raise and lower the platform 18, or to permit the platform 18 to descend gradually as required during build-up of a pile of sheets.

Customarily, the platform 18 is supplied with the skid 24, which actually receives sheets delivered by the conveyor 10 as they are released by the gripper fingers 13. In conventional fashion, a tail slowdown system 25 is provided to first tauten sheets held by the gripper fingers 13 as they pass over the pile, and to then release the sheets for gentle descent to the pile. A rear jogger plate 26 is provided at the rear of the pile and squares sheets against end gates 27. At the same time, a pair of side jogger plates 28 square the sides of the pile to provide a neat block or pile of sheets.

Standard Pile Delivery

In one conventional use of my delivery system, a full pile of sheets may be provided on the skid 24, the skid lifted from the platform 18 and the full pile removed.

Continuous Delivery

Figure 2:
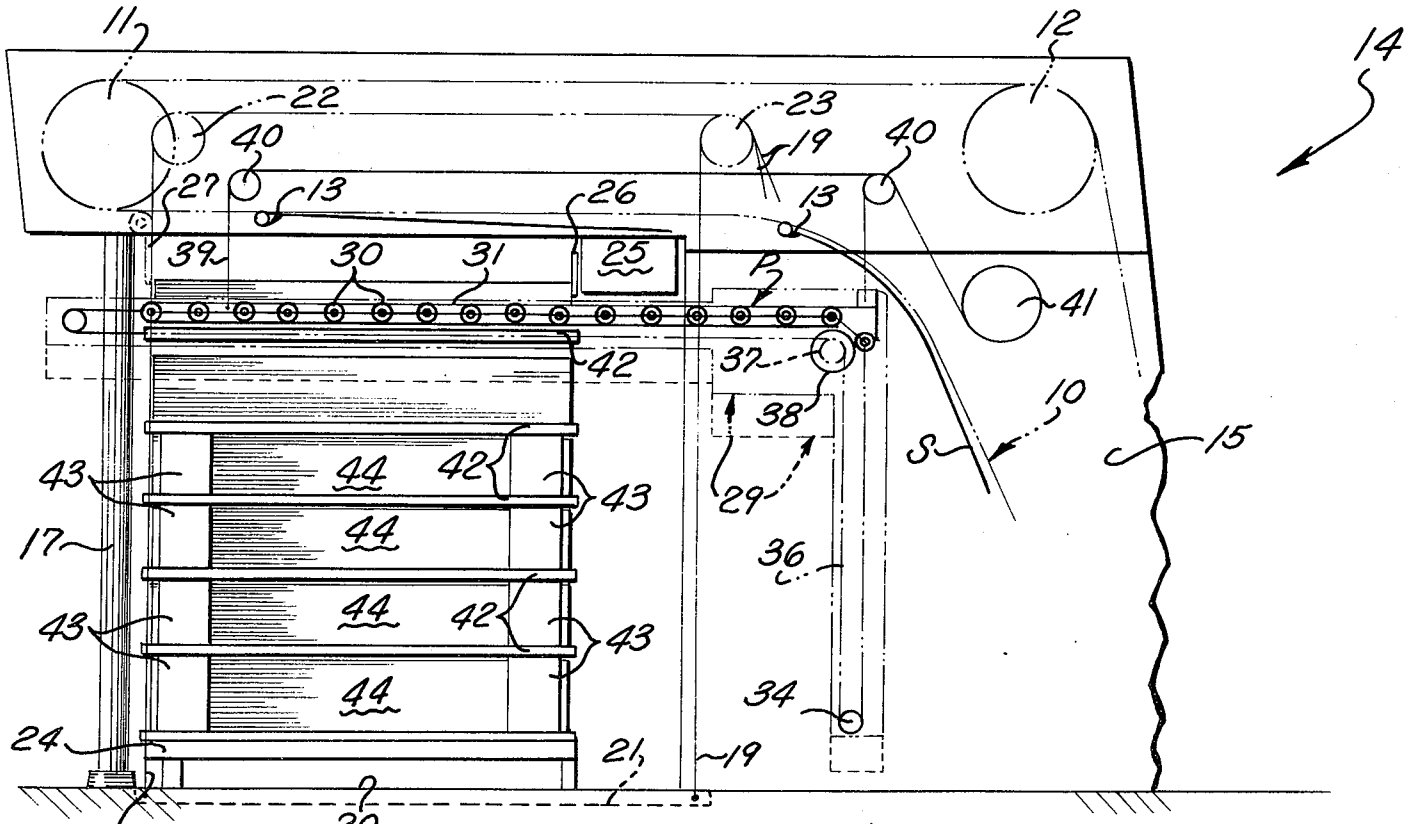
FIG. 2 is a view similar to FIG. 1, wherein the auxiliary device is located in its operative position for temporarily supporting a small pile of sheets during removal of a full, racked pile from the main hoist.

If it is desired to operate the sheet handling machine and delivery in non-stop or uninterrupted fashion, an auxiliary hoist 29 may be employed to temporarily intercept sheets being delivered by the conveyor 10 while the main pile is being removed from the platform 18. For this purpose, the auxiliary hoist includes a platen P which is provided with a plurality of rollers 30 about which a curtain or wide belt 31 passes. The belt 31 preferably spans the width of the rollers 30. An anchor bar 32 is fixed in a pair of spaced side frames 33 of the auxiliary hoist 29 and anchors both opposed ends of the belt 31. The frames 33 extend in a substantial L-shape configuration downwardly and leftwardly from the location of the bar 32. At the extremities of these two extensions, pairs of idler sprockets 34 and 35 are mounted. A pair of laterally-spaced chains 36 pass around the sprockets 34 and 35. Drive sprockets 37 engage the chains 36 and are interconnected to be driven by a reversible motor (not shown) so that the platen P may be moved from its inoperative position shown in FIG. 1 in which it is outside the area of receipt of sheets, to an operative position as shown in FIG. 2. In the latter position, it is arranged to intercept sheets and temporarily support a newly-forming pile while other tasks are being performed below the platen. As shown in FIG. 1, the sprockets 37, when driven in a clockwise direction, will pull the chains 36 counterclockwise around the sprockets 35. The upper run of the chain passing around the sprockets 35 is connected to ends of the first one of the rollers 30, i.e., the one at the leftward-most position of the platen P. All the rollers 30 are interconnected at their ends so that as the first roller is pulled, all rollers will move in unison into sheet intercepting position. The connections of the rollers are designed to enable articulation of the platen P during movement. The opposite end of the chains 36 is connected tc the last of the train or rollers 30, as shown adjacent the sprockets 34 in FIG. 1.

Figure 7:
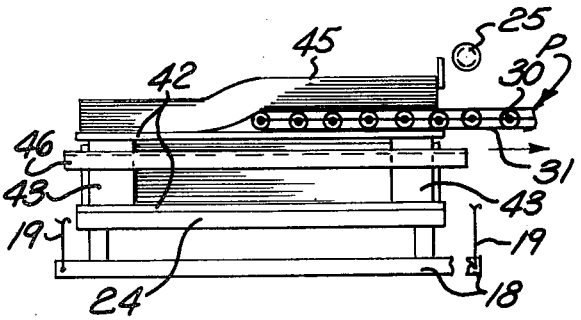

A roller 38 supports the belt 31 during movement of the platen between its operative and inoperative positions. By anchoring the two ends of the belt 31 to the bar 32, it will be seen that the upper run of the horizontal section of the belt will avoid horizontal movement. This is due to the anchoring of the bar 32 and the rolling action of the leftward roller 30 of the platen. Only the lower run of the belt moves leftwardly during platen insertion. The frames 33 are supported by cables 39 which pass around pulleys 40. These cables 39, as well as the cables 19 for the main hoist, support their respective hoists approximately at their four corners. A motor 41 winds up or pays out cables 39 as commanded by the operator or by automatic control mechanism. As shown in FIG. 1, the upper horizontal run of the belt 31 is closely adjacent the bottom of the tail slowdown system 25. The auxiliary hoist 29 is capable of descending under automatic control from pile top sensing mechanism, (not shown) in conventional fashion, so that the high speed build-up of sheets on the platen can be accommodated. In practical use, the vertical range of movement of the auxiliary hoist 29 is preferably at least five or six inches. While the platen P is in the position of FIG. 2 and is temporarily receiving sheets, they are being jogged by the jogger plates 26 and 28. Obviously, before the platen can be inserted to receive sheets, the top of the pile on the skid 24 must necessarily be lowered to a position below the lower run of the belt 31. The insertion is arranged to take place in approximate timed relation with the travel of one set of gripper fingers 13, whereby the platen P may move in above the last-released sheet and below a sheet which is still held by the gripper fingers 13 and under tension by the tail slowdown system 25. Once inserted, the platform 18 can be lowered and the full pile removed from the delivery. A new skid 24 may then be placed on the platform and brought closely adjacent the lower run of the belt 31. The sprockets 37 may then be operated in a counterclockwise direction, in which the chains 36 pull on the rightward-most roller as shown in FIG. 2, to cause the platen to return to the FIG. 1 position. As this is done, the upper run of the belt 31 has no horizontal movement relative to the bottom of the pile on the platen. Preferably, the new skid was previously placed in close relationship to, but not touching the bottom of the belt 31, since the bottom run will have a rapid movement in a rightward direction and should avoid contact with the skid. Reference may be made to FIG. 7 to see the condition of the platen during partial withdrawal, as the pile of sheets thereon is being deposited on a surface below the platen. In this example, that surface is the new skid 24.

Upon completion of withdrawal of the platen from pile-supporting position, the motor 41 is immediately operated to raise the auxiliary hoist 29 to its upper limit in readiness for reinsertion of the platen when next needed.

Continuous Racking

The previously-described mechanism and its operation is conventional, but its understanding is necessary to fully appreciate its functional relationship to the mechanism about to be described for accomplishing continuous racking of sheets with only a single delivery.

Figure 3:
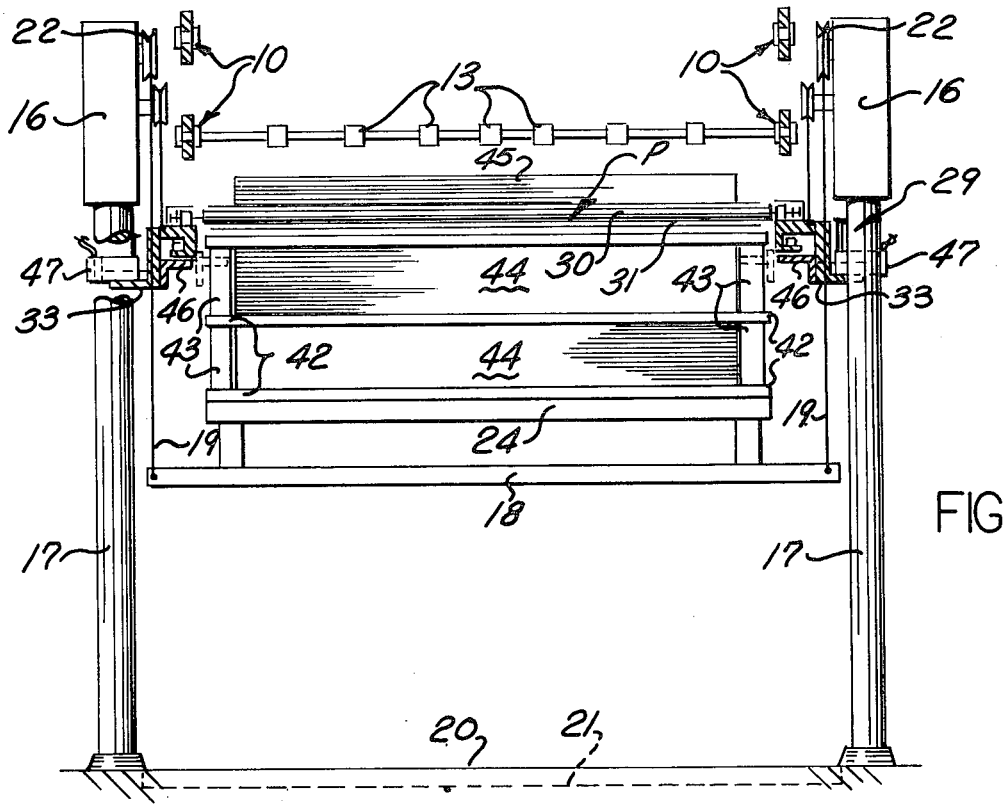
FIG. 3 is an end view of the delivery taken looking in the direction of the arrow 3 of FIGS. 1 and 2.
Figure 6:
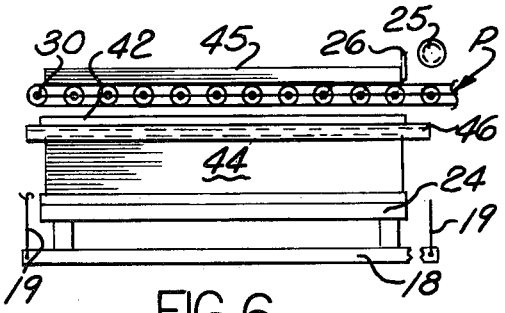

Racking in the accepted trade sense is best described in the aforementioned Rooney patent, wherein small piles of sheets are built up and are separated by plywood or similar boards, which have corner legs supporting the boards. In this fashion, each pile is independent of all other piles, greatly facilitating sheet drying time and preventing off-setting of freshly-printed ink from one sheet to the next. During racking, a pair of side ledges are temporarily moved into position to support the boards, while corner blocks are located around the small pile therebeneath. The main pile is raised to cause the corner blocks to lift the board and its small pile from the ledges, after which the ledges are withdrawn to enable normal automatic descent of the newly-forming pile under the control of a pile height sensor. Alternatively, the board may be received by the blocks before the platen is withdrawn. Such mechanism is shown principally in FIGS. 1 and 3, the latter figure being best for illustrating the operation of the invention. In FIG. 3, two small piles have been built up on top of skid 24. A board 42 may, if desired, be located on top of the skid 24. Legs 43 have been provided between the lowermost board 42 and each of a pair of other boards 42 thereabove. It will be noted that the boards 42 are slightly spaced above the small sheet piles 44 to avoid the weight being transmitted to the small piles. The platen P shown in cross section in FIG. 3 supports a newly-forming pile 45. Thus, the platen is in the inserted position of FIG. 2 at this time. A pair of ledges 46, which are formed preferably as angle irons, are movable between their full and dotted-line positions by means of air cylinders 47 mounted on the side frames 33 of the auxiliary hoist 29. The air cylinders 47 are in the position in which they have retracted the ledges 46 outwardly, and are movable to their dotted-line positions shown in FIG. 3 to temporarily support the boards 42 when required. It will be noticed that the legs or blocks 43 appear to interfere with the dotted-line positions of the ledges 46. Normally, the blocks 43 would be positioned inwardly from the ledges 46, and may in fact, be inwardly of the side edges of the piles 44. If desired, however, the ledges 46 may be provided with cutouts to permit vertical passage therethrough of the blocks 43. Immediately preceding the position of the piles 44 in FIG. 3, for purposes of explanation, let us assume the air cylinders 47 had urged the ledges 46 into their inward or dotted-line positions in which they may receive a board 42 thereon. Prior to board insertion, the platen P will have been inserted to receive sheets, after which a control for the air cylinders 47 is operated to urge the ledges 46 inwardly toward each other. At that time, a board may be inserted from the left end of FIG. 1 by resting it on a pair of stationary ledge portions 48 which are carried by the side frames 33 of the auxiliary hoist 29. When the platen is completely in position, the board may be slid rightwardly as viewed in FIG. 1, until it goes to the full depth at which it is stopped. This position is shown in FIG. 6. Then, the legs or blocks 43 may be positioned at the corners of the next lower board 42, after which the main hoist is raised under manual control of the motor for operating the cables 19 until the legs 43 lift the board 42 off the ledges 46 and bring it closely below the lower run of the belt 31 of the platen as shown in FIG. 3. The air cylinders 47 may then be operated to retract the ledges 46 to their full line positions of FIG. 3. The platen may then be withdrawn to deposit the newly-forming pile 45 onto the board 42 just below the platen, while continuing to form the new pile. The vertical dimension of the platen will cause a drop in the pile 45, which may require raising the main hoist an additional amount until the top level of the pile is at the proper level for receipt and jogging of sheets. Ordinarily, however, in a high speed machine, the small pile will be built up sufficiently to maintain its top level within the range of the joggers during and after platen withdrawal. Return from "manual" control to "automatic" lowering of the main hoist is then simply performed by the operator handling the necessary controls.

Figure 4:
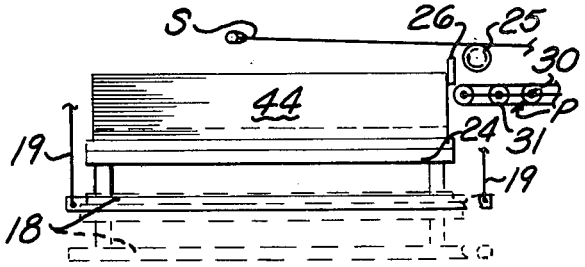
FIGS. 4 through 7 are simplified side views of the device illustrating certain steps of the general procedure followed when racking small piles of sheets.
Figure 5:
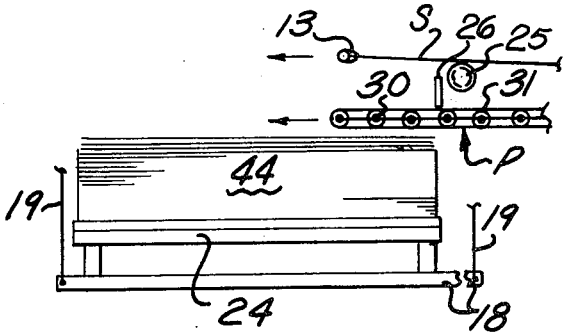

When the pile on the uppermost board 42 has formed to a sufficient height, the pile will be approximately as shown in FIG. 4. To commence another racking operation the platform 18, skid 24 and pile or piles on the skid are lowered to the dotted-line position of FIG. 4, in which the uppermost level of the pile is below the lower run of the belt 31 of the platen. Initially, while sheets continue to be delivered, they will float down to the lowered pile. Then, as shown in FIG. 5, the platen P is inserted leftwardly in timed relation with delivery of sheets by the grippers 13. The last previous sheet to have been delivered by the grippers 13 is now below the level of the platen, and the movement of the platen in the same direction as delivery of the new sheet S avoids disturbance of the sheet being delivered. The tail slowdown system 25 is shown in FIGS. 4 through 7 as being a vacuum roller which rotates in the direction of sheet movement at a slightly slower surface speed than sheet delivery. This type of mechanism is conventional, and need not be described further herein.

Once the platen is fully into position as shown in FIG. 6. and sheets begin to form into a new pile 45, the ledges 46 are moved into their board-supporting position, after which a board 42 is slid in location on the ledges 46. It will be noted in FIG. 6 that the top of the small pile 44 is below the bottom of the horizontal portion of the ledges 46 when the ledges support a board. Between the sequential positions of the mechanism of FIG. 6 and FIG. 7, the blocks 43 are located on the lower board 42 and the main hoist is raised to cause the blocks 43 to lift the upper board 42 from the ledges 46. Once lifted, the ledges 46 may be retracted to their full-line positions as shown in FIG. 3, and, with the upper board 42 immediately below the platen, the platen may be withdrawn in the direction of the arrow in FIG. 7 to deposit the pile 45 onto the board 42. Obviously, I can use the mechanism shown and described herein both for continuously racking or racking and interrupting machine operation after a skid has been fully-loaded with racked piles. When continuously racking, for example as shown in FIG. 2, several racks will be piled on the skid 24 and the platform lowered into the recess 21 to permit removal of the skid and racked piles from the single delivery. Then, I can put a new skid 24 on the platform 18, raise it to just below the platen or just below a new board 42 placed on the ledges 46, and can effect transfer as previously described to commence build-up of another full pile of racked sheets.

Having described my invention, I claim:

1. A continuous sheet delivery for racking individual small sheet piles on a pile platform wherein the piles are built from the bottom up by delivering sheets to a skid on said platform to form a pile of sheets on the skid, placing a relatively stiff board above the pile, supporting the board from the skid outside the edges of the pile thereon and building subsequent small piles in the same fashion with additional boards serving to support the small piles independently of one another, said delivery comprising:

a pair of side frames, a delivery conveyor mounted in said side frames for delivering sheets individually in a horizontal direction, a main hoist for supporting said skid for vertical movement between a sheet-receiving position immediately below said conveyor and a lower pile-unloading position, an auxiliary hoist having frame means at the outer sides of said piles, means for raising and lowering said frame means between an upper sheet-receiving position immediately below said conveyor and a lower limit sufficiently below said upper position to allow for build-up of sheets on said auxiliary hoist while a full pile is being removed from said platform, a pile supporting member carried by said auxiliary hoist and movable between an inoperative position clear of the pile at one side thereof to an operative, horizontal sheet-intercepting position, board-supporting members carried by the frame means of the auxiliary hoist at the sides of the pile, said board-supporting members comprising horizontal ledges on which boards may be slid below said pile supporting member when the latter is in its operative position, the relationship of said ledges and pile supporting member being such that the top of a board on said ledges is out of contact with but is closely adjacent the bottom of said pile supporting member, and means for moving said ledges toward each other to an operative position in which the ledges receive and support the sides of a board and away from each other to an inoperative position spaced beyond the edges of a board, whereby said board and a small pile of sheets received from said pile supporting member may be transferred to said main hoist and lowered past said ledges.

2. A continuous delivery as defined in claim 1 wherein said pile supporting member has its inoperative position located at that side of the pile from which sheets carried by said conveyor approach the pile, and further including means for moving said pile supporting member from its said inoperative position into its said operative position.

3. A continuous delivery as set forth in claim 1 wherein said pile supporting member comprises a plurality of parallel rollers extending laterally with respect to their direction of movement between their operative and inoperative positions, track means guiding said rollers at their ends, a curtain anchored at one end, extending over the top of the rollers in the direction in which sheets are delivered and looped around and extend in the opposite direction below said rollers, and tension means for enabling paying out and taking up of said curtain when said pile supporting rollers are moved between their operative and inoperative positions respectively.

4. A continuous delivery as set forth in claim 1 wherein said means for moving said pile supporting means into operative position is timed in operation in relation to sheet movement along said conveyor.

5. A method of continuously racking individual small piles of sheets comprising the steps of:

delivering individual sheets along a substantially horizontal path to a delivery station for release and settling on a first horizontal supporting surface therebeneath, lowering said first surface at a first speed coordinated with the rate of sheet delivery as sheets are being built up thereon to maintain the top of the pile at an approximate sheet-receiving level, when a small pile of predetermined height has been built on said first surface, rapidly lowering said first surface at a second higher speed and rapidly inserting a temporary, relatively thin, second horizontal supporting surface into position at a first upper level to receive sheets thereon, lowering said second surface at said first speed as sheets are being built up thereon to maintain the top of the pile on said second surface at the approximate sheet-receiving level while said second surface descends toward a second lower level, locating a third horizontal supporting surface immediately adjacent and spaced closely below said second surface and temporarily simultaneously lowering said second and third surfaces in synchronism at said first speed, raising said first surface to support said third surface independently of the pile of sheets carried by said first surface, horizontally withdrawing said second surface while simultaneously restraining the pile being formed thereon against horizontal movement and thereby depositing said pile onto said third surface, raising said first and third surfaces and the piles thereon until the top of the pile on said third surface is at said approximate sheet-receiving level, and continuing the delivering of individual sheets throughout.

6. The method of claim 5 wherein insertion of said second supporting surface is in the direction of and timed with the delivery of individual sheets into said delivery stations.

* * * * *